United States Patent [19]

Treslo

[11] Patent Number: 4,476,698

[45] Date of Patent: Oct. 16, 1984

[54] KEYLESS LOCK

[76] Inventor: Nicholas Treslo, 1747 N. 79th Ave., Elmwood Park, Ill. 60635

[21] Appl. No.: 473,706

[22] Filed: Mar. 9, 1983

[51] Int. Cl.[3] ..... E05B 37/14; E05B 37/18

[52] U.S. Cl. ..... 70/25; 70/306; 70/312; 70/321; 70/327; 70/DIG. 9

[58] Field of Search ..... 70/25, 27, 28, 214, 70/288, 301, 304–308, 312, 315, DIG. 9, 24, 29, 321, 322, 53, 327

[56] References Cited

U.S. PATENT DOCUMENTS

| | | | |
|---|---|---|---|
| 86,908 | 2/1869 | Cole et al. | 70/304 |
| 221,258 | 11/1879 | Walker | 70/25 |
| 543,404 | 7/1895 | Root | 70/306 |
| 1,056,667 | 3/1913 | Hansen et al. | 70/28 |
| 1,123,061 | 12/1914 | Alanchikoff | 70/28 |
| 1,483,993 | 2/1924 | Sprowles et al. | 70/306 |
| 2,049,983 | 8/1936 | Voges | 70/306 |
| 2,852,928 | 9/1958 | Miller | 70/25 X |
| 2,928,271 | 3/1960 | Watson | 70/25 |
| 4,047,406 | 9/1977 | Foote | 70/25 |

FOREIGN PATENT DOCUMENTS

| | | | |
|---|---|---|---|
| 672949 | 3/1939 | Fed. Rep. of Germany | 70/25 |

*Primary Examiner*—Gary L. Smith
*Assistant Examiner*—Russell W. Illich
*Attorney, Agent, or Firm*—Basil E. Demeur; Robert E. Knechtel

[57] ABSTRACT

A keyless lock which eliminates the requirement for visual contact with the lock to effect disengagement thereof. A series of push buttons are operated by depressing each push button the proper number of times according to a predetermined numerical code. The push button increment ratchet wheels having slots therein. When the slots are in proper alignment with lock releasing pins, the lock can be opened.

8 Claims, 5 Drawing Figures

KEYLESS LOCK

BACKGROUND AND SUMMARY OF THE INVENTION

This invention relates to locks and more particularly to a lock which does not require a key for opening it. It is further directed to a lock which eliminates the requirement for visual contact with the lock to effect disengagement thereof.

In the past there have been several types of keyless locks which have been constructed to operate by rotable wheels having certain numerical permutations which when properly set disengage the lock. However, such locks have generally required the operator to have visual contact with the lock so that the operator can see the numbers on the wheels which would indicate the settings of the tumblers in order to set the combination to open the lock.

One such example is illustrated in U.S. Pat. No. 86,908 entitled "Permutation Lock". This early patent illustrates the use of a series of three wheels each of which has a flat depression located along the periphery of the wheel. The operator rotates each of the three wheels to the proper position according to a preset combination, and three respective bolts are permitted to fall flat onto the flat portions of the wheel thereby releasing the slide bolt locking mechanism. This then releases the lock. However, this device requires the operator to see the numbers on the wheels so that the operator must have visual contact with the wheels in order to set the proper combination.

Another device is illustrated in U.S. Pat. No. 543,404 entitled "Lock". In this device there are a series of wheels which have a gear tooth mounted thereon, with a pawl holding the gear tooth in position. The operator depresses each of a series of external levers to operate the pawl to rotate the gear tooth and the wheels. Each of the wheels includes a recess so that when all of the wheels are in the proper position, a lock arm is permitted to fall downwardly into the recesses. The lock arm thereby releases the bolt which may then be slid laterally to open the lock. This device does not have a zeroing or reference position to set the wheels such that the operator can operate each external lever a predetermined number of times from the reference position in order to effectuate opening of the lock. This device uses a friction brake which must be sensed by the operator to establish reference position. Thus, the operators sense of feeling the reference position by means of the friction brake introduces the possibility for error which is dependent upon the sense of touch of the operator.

U.S. Pat. No. 1,123,061 entitled "Padlock" illustrates a series of four levers having external knobs positioned thereon. Only one of the knobs will operate to release the latch and thereby permit the lock to open. The elongated lever which will operate the lock causes a pivoting of the latching bolt thereby releasing the shackle. This lock does not require a numerical permutation in order to release the lock.

U.S. Pat. No. 1,056,667 shows a keyless lock wherein there are a series of four wheels which have numerical designations thereon. As the knobs are turned, the inner ends of the knobs are constructed in the form of pins having recesses in order to permit the stops on a bolt operating member to slide into the recesses. When the pins on the knobs are turned in the right direction, according to a predetermined combination, each of the stops will be permitted to slide into an appropriate recess, such that the bolt will be permitted to slide thereby releasing the latch. Again, this device requires the operator to visually see the knobs and dial the proper combination to open the lock.

The "Permutation Lock" illustrated in U.S. Pat. No. 1,483,993 illustrates a locking device which can lock a bolt in either of two positions. A notch is positioned on the tumbler to either align with the bolt permitting the bolt to slide or to not align with the bolt, prohibiting movement. The position of the tumbler is changed by a push button and pawl arrangement. A brake is applied to the tumbler to keep it from movement until the brake is released.

The main problem with the patents illustrated in the prior art is that they cannot easily and conveniently be used by a person who cannot see or have visual contact with the lock. Particularly, the operator must be able to see the numbers on the lock operator so that the proper combination can be dialed and set. The present invention uses a lock which eliminates this requirement. Particularly, the operator must only push the push-button operators to increment internal ratchet wheels to the proper position such that the shackle can be released from the lock. The operator can further initiate an operation which will set the ratchet wheels to a predetermined initial reference orientation. From this reference position, the operator can operate each push-button the predetermined number of times, which is the preset combination of the lock, such that the ratchet wheels will be in the proper lock opening position. All of this can be done without the operator seeing the lock or the push-button operators.

The inventive lock is permitted to be opened when the ratchets are in the proper lock opening position by merely pulling on the lock casing or shackle. This causes a locking bar to exert a force on internal members of the lock, which cause pins to be forced into and received by aligned slots on the ratchet wheel, which permits the locking bar to be moved into a lock opening condition. When the slots on the ratchet wheel are not in proper alignment, the locking bar cannot be moved nor the shackle released from the lock casing.

Thus, it is an object of the present invention to provide a keyless lock which eliminates the requirement for visual contact with the lock by the operator to effect disengagement thereof. Related thereto is the object of providing a keyless lock which has push-button operators as a part of the lock, the push-button operators being operable to rotate internal ratchet wheels of the lock such that the ratchet wheels can be aligned in a proper lock opening position by merely pushing the push buttons a proper number of times according to a predetermined numerical code. It is a related object to provide a keyless lock as described above wherein the ratchet wheels are set to a predetermined reference position by the operator before initiating the numeric code in push-button sequence.

Many other objects and advantages of the invention will be clear from the following detailed description of the preferred embodiment.

DETAILED DESCRIPTION OF THE PREFERRED EMBODIMENT

Figure 1:
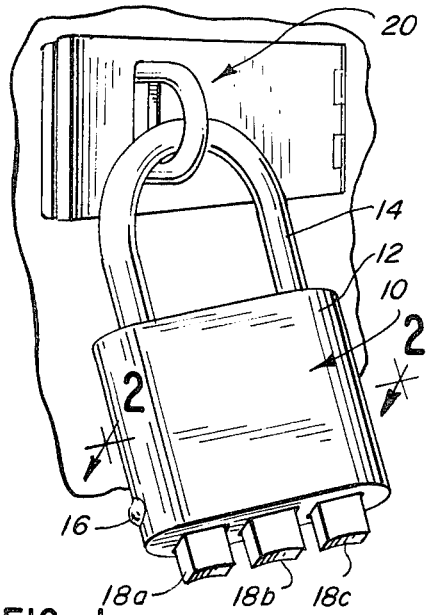
FIG. 1 is a perspective view of the inventive keyless lock in a typical installation wherein a hasp is locked.

Turning first to FIG. 1, there is illustrated a keyless lock 10 having a casing or body portion 12 and a u-shaped shackle 14 extending from the top of the casing 12. The shackle 14 provides the means by which devices such as a hasp 20 can be secured. A dimple 16 extends from one side of the casing 12. There are several push buttons 18*a*, 18*b* and 18*c* (sometimes referred to generally as push buttons 18) extending from the bottom of the casing 12 opposite the shackle end. The dimple 16 provides a reference orientation for the operator such that merely by feeling the dimple 16 the operator knows which side of the lock is the left or right with respect to the push buttons 18.

Figure 2:
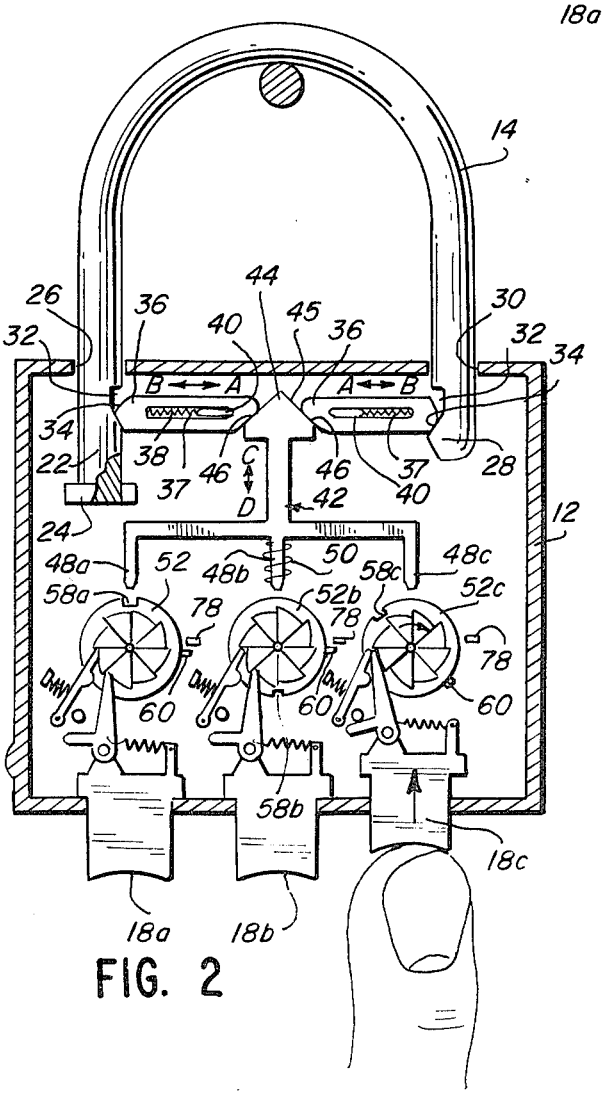
FIG. 2 is a cross-sectional enlarged view with portions removed taken along line 2—2 of FIG. 1.

FIG. 2 illustrates the internal operating mechanism of the lock 10. It can be seen that the shackle 14 has a pivot end 22 having an abutment 24 at its lowermost portion. The pivot end 22 passes through a circular opening 26 in the top of the casing 12. The other end, or releasing end 28 of the shackle passes through a similar circular opening 30 in the casing 12. Each end of the shackle 14 has a notch 32 having an inclined surface 34 extending from the bottom of the notch to the outer circumferential surface of the shackle 14.

Engaging each of the notches 32 are a pair of locking bars 36 each capable of limited, restricted movement in the directions indicated by arrows A–B. The locking bar 36 has an internal channel 37 which retains a compressed conical spring 38 with one end thereof secured against to a guide pin 40. The guide pin 40 is affixed to the casing 12 such that it is stationary. The conical spring 38 thus pushes against the locking bars 36 in the direction of arrow B, which is toward the respective notch 32 of the locking bar 36. The locking bar 36 is normally positioned in the notch 32 for locking the shackle 14.

In the locked condition illustrated in FIG. 2, the locking bars 36 rest against a forked member 42 having a pointed top 44 with conical sides 45. The locking bar 36 has a rounded cammed surface 46 which contacts the conical sides 45. The forked member 42 is retained within the casing 12 such that it can only move in the direction of arrow C–D, but is restricted from other movement. This can be effected by means of sleeve bearings or similar retaining devices which are not illustrated but readily apparent to one skilled in the art. At the end of the forked member 42 opposite the pointed top 44 is a series of pins 48*a*, 48*b*, and 48*c* (generally referred to as pins 48). A spring 50 is wrapped around the center pin 48*b* and which applies a force to the forked member 42 in the direction of arrow C. Thus, in its normal locked condition, the forked member 42 has a pointed top 44 applying a force against the locking bars 36 in the direction B.

Figure 4:
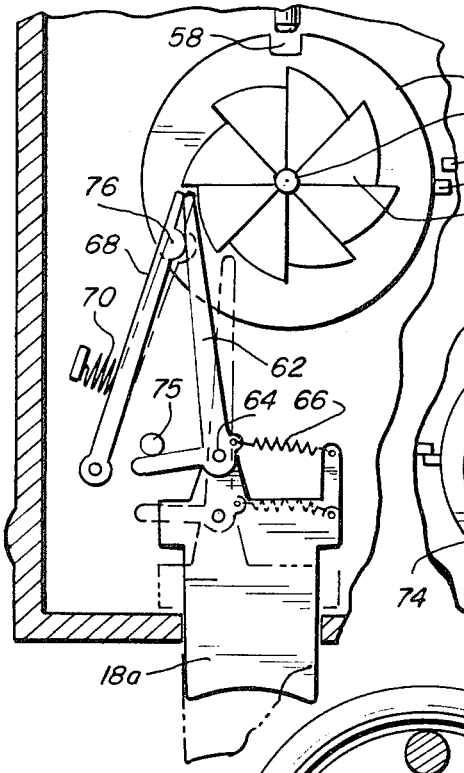
FIG. 4 is an enlarged cross-sectional view of one of the push button operators illustrated in FIG. 2.

Positioned below each of the pins 48 are a series of ratchet wheels 52*a*, 52*b* and 52*c* (generally referred to as ratchet wheels 52) which can be more clearly seen in the enlarged view of FIG. 4. Each ratchet wheel 52 is mounted on a shaft 54 for rotation. There are ratchet means 56 on one side of each ratchet wheel 52. On the outer circumference of the wheels 52*a*, 52*b* and 52*c* are slots 58*a*, 58*b* and 58*c* respectively (generally referred to as slots 58). Also on the outer circumference of each wheel 52 is a stud 60 projecting outward.

A pawl 62 is seen engaging the ratchet means 56 to drive the ratchet wheel 52 in a clockwise direction. The pawl 62 is connected to the push button 18*a* by a pin 64. The pawl 62 is further connected to the push button 18 by means of a tension spring 66 which pulls the pawl against the ratchet means 56. The tension spring 66 further repositions the pawl 62 for the next operation of the push button 18 such that with each operation of the push button 18 the pawl 62 increments the ratchet wheel 52 one incremental position.

In order to lock the ratchet wheel 52 in the incremented position after the push button 18 increments the wheel one position, a locking pawl 68 having a compression spring 70 locks against the ratchet means 56 during the withdrawal of the push button 18 from the casing 12. This is illustrated as the dashed line position in FIG. 4 whereas the solid line position would be the operational condition of the push button as it is pushed in to increment the ratchet wheel 52.

Figure 5:
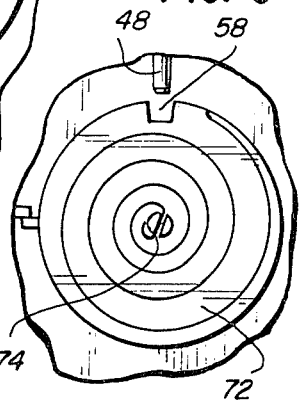
FIG. 5 is a rear view with portions removed of the ratchet wheel of FIG. 4 illustrating the spring used to set the ratchet wheel to its initial reference position.

The opposite side of the ratchet wheel 52 is illustrated in FIG. 5. A clocklike spring 72 is wrapped around a central retainer 74. As the ratchet wheel 52 is incremented in the clockwise direction as seen in FIG. 4, the clocklike spring 72 is placed in tension and supplies an opposite counterforce.

In order to set the ratchet wheel 52 in its initial reference position, the push button 18 is pushed into the casing 12 as far as possible. This causes the pawl 62 to strike a post 75 mounted to the casing 12. The pawl 62 pivots about pin 64 and strikes a cammed surface 76 on the underside of the locking pawl 68. Both the pawl 62 and locking pawl 68 are then forced out of engagement with the ratchet means 56. As there is now only the clocklike spring 72 providing a counterforce, the ratchet wheel 56 is free to rotate in the counterclockwise direction as seen in FIG. 4 due to the force of the spring 72. The stud 60 strikes a detent 78 which is affixed to the casing 12. Thus, an initial reference position of the ratchet wheel 52 is provided.

Before the operator begins the opening or unlocking sequence of the lock, he must first set all of the ratchet wheels 52 to their initial reference position in which the stud 60 is against the detent 78. Thus each push button 18 is pushed all the way into the casing 12 such that the pawl 62 and locking pawl 68 are released from the ratchet means 56 and the wheel is allowed to assume its initial reference position. This is illustrated in FIG. 2 by ratchet wheels 52*a* and 52*b*. It can be seen that the studs 60 are against their respective detents 78.

In order for each lock to have a different combination or numerical code, the slots 58 in the wheels 52 are placed at different positions along the circumference of the wheels 52. It can be seen that the left push button 18*a* does not have to be operated in order to place the slot 58*a* in alignment with its respective pin 48*a*. Looking at the center push button 18*b*, it can be seen that the slot 58*b* is approximately 180° away from being aligned with its respective pin 48*b*. Ratchet wheel 52*b* must be incremented the proper number of times in order to place the slot 58*b* in alignment with its respective pin 48*b*. The incrementing of the wheel 52*c* is seen in the right push button 18*c* being operated in FIG. 2. Here, the push button 18*c* has been operated once already as seen by the position of the stud 60 being incremented one incremental position away from its detent 78. The slot 58*c* has been moved one incremental position toward its respective pin 48*c*. A second operation of the right push button 18*c* will increment the wheel one additional position and place the slot 58*c* in alignment with its respective pin 48*c*. Thus, for the lock illustrated in FIG. 2, the operator would not have to push the left push button 18*a*, the center push button 18*c* four times, and the right push button 18*c* two times in order to align the slots 58*a*, 58*b* and 58*c* with their respective pins 48*a*, 48*b* and 48*c*.

Figure 3:
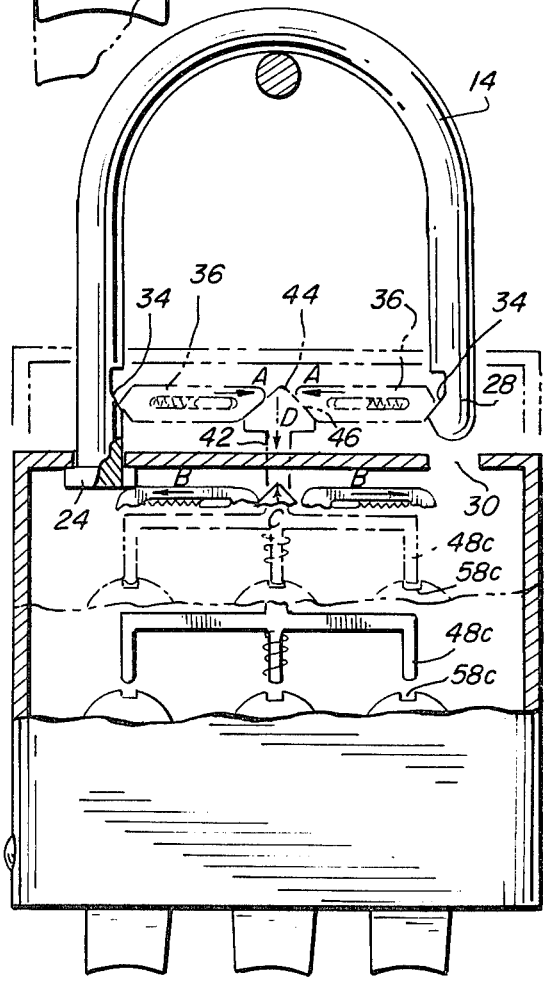
FIG. 3 is a cross-sectional view with portions removed illustrating the lock in two positions, the solid line position illustrating the lock opened position, and the dashed line position illustrating the lock as it is being moved into the lock opened position.

When the pins are in alignment with their respective slots, the shackle 14 can be pulled up such that its releasing end 28 will clear the top of the casing 12. This can be seen in FIG. 3. The locked positions illustrated by the dashed lines of this figure. To open the lock, the shackle 14 is pulled upward which causes inclined surfaces 34 to push against the lock bars 36 causing a force to be exerted thereon in the direction of the arrow A. The cammed surfaces 46 push against the pointed top 44 and its respective conical sides 45. This in turn causes the forked member 42 to be pushed downward in the direction of arrow D. If all of the slots 58 are in alignment with their respective pins 48, the pins are received in their respective slots and the forked member 42 is permitted to move downward a sufficient distance to allow the locking bars 36 to slide along their internal channels 37 in the direction of Arrow A an amount sufficient to allow the locking bar 36 to clear the notch 32. The releasing end 28 of the shackle 14 is permitted to ride over the end of the locking bar 36 and is thus released from the casing 12. With the shackle 14 released from the casing, the forked member 42 will no longer be forced downward as a result of a force being applied against its pointed top 44 and the forked member will again assume the solid line position. When it is desired to relock the shackle 14, a reverse procedure is followed and the shackle is pushed into the lock casing 12. The releasing end 28 and the abutment 24 will push down against the locking bars 36 and due to the semicircular ends of the locking bars 36, will cause a force to be exerted in the direction of the arrow A. This causes the forked member to be pushed down such that the pins 48 are once again received by their respective slots 58. After the abutment 24 and the releasing end 28 have passed over the locking bars 36, the locking bars 36 will engage the notches 32 and the forked member will assume its solid line position as illustrated in FIG. 3.

The ratchet wheels 52 are rotated such that the slots 58 are no longer in alignment with their respective pins 48. This will prevent the unintentional or unauthorized opening of the lock uless the proper sequence of operations of each push button is again initiated. It can be seen that unless the slot 58 is in alignment with its respective pin 48, the forked member 42 cannot be moved downward in the direction of Arrow D due to the pin 48 striking the circumference of the wheel 52. Thus, the locking bars 36 cannot move a sufficient distance in the direction A to permit the release of the shackle from the locking bars 36.

Thus it is apparent that there has been provided, in accordance with the invention, a keyless lock that fully satisfies the objects, aims, and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variation as fall within the spirit and broad scope of the appended claims.

I claim:

1. A keyless lock which eliminates the requirement for visual contact with the lock to effect disengagement thereof comprising:

a casing a shackle with a portion thereof extending into the casing and having a locking notch formed therein, at least one locking bar adapted to engage the locking notch of the shackle to lock the shackle within the casing, means to release the locking bar from engagement with the locking notch thereby permitting movement of the shackle out of the casing formed by:

a forked member having one end engaging the locking bar to prevent movement thereof when in the locked position, a plurality of pins on the forked member opposite the end engaging the locking bar, a plurality of ratchet wheels, each ratchet wheel having a slot formed therein, the ratchet wheels being adapted to rotate incrementally, means to position the ratchet wheels in an initial reference position, push button means associated with each ratchet wheel, and being connected to a first pawl which engages and rotationally drives the ratchet wheel from its initial reference position to an incremented rotated position, each push-button means having a predetermined numerical code to increment its respective ratchet wheel to a slot and pin alignment position, whereby the lock can be opened without visual contact by pushing each push-button means the predetermined numerical code number to align each slot with its respective pin on the forked member, and pulling on the shackle which in turn causes the locking bar to exert a force on the forked member thereby causing the pins on the forked member to be forced into and received by the aligned slots on the ratchet wheel, permitting movement of the locking bar and releasing the shackle.

2. The keyless lock of claim 1 wherein the means to position the ratchet wheels in an initial reference position comprise:

stud means on each ratchet wheel, fixed detent means which engage the stud means to provide the initial reference position for the ratchet wheel, spring means connected to each ratchet wheel to apply a rotative force in a direction opposite the direction of rotation which the first pawl drives the ratchet wheel, release means to disengage the first pawl from the ratchet wheel, releasing the ratchet wheel and allowing the spring means to rotate the ratchet wheel until the stud means engages the detent means.

3. The keyless lock of claim 2 and further comprising:

second pawl means to retain the ratchet wheel in its incremented position when the push button is released, the release means which disengage the first pawl further disengaging the second pawl when the ratchet wheel is to be returned to its initial reference position.

4. The keyless lock of claim 1 wherein the shackle is a u-shaped member, with each end thereof extending into the casing, and having a locking notch formed in each end.

5. The keyless lock of claim 4 and further comprising two locking bars, each adapted to engage one of the locking notches formed in the u-shaped member.

6. The keyless lock of claim 5 wheren the locking bars engage a conical surface on the end of the forked member along opposite sides thereof, the locking bars forcing the forked member and the pins into engagement with the slots when the shackle is pulled.

7. The keyless lock of claim 6 wherein the locking notches have inclined surfaces to allow the locking bars to slide over the inclined surface to release the shackle when the pins and slots are aligned.

8. The keyless lock of claim 7 wherein the one end of the locking bar engaging the conical end of the forked member forces the conical end of the forked member towards the ratchet wheels, the ratchet wheels prohibiting sufficient movement of the forked member to allow the locking members to slide over the inclined surface of the locking notch on the shackle unless the slots on the ratchet wheel are aligned with the pins on the forked member.

* * * * *